United States Patent [19]

Walker

[11] Patent Number: 4,883,403

[45] Date of Patent: Nov. 28, 1989

[54] IMPELLERS FOR CENTRIFUGAL PUMPS

[75] Inventor: Craig I. Walker, Artarmon, Australia

[73] Assignee: Warman International Limited, New South Wales, Australia

[21] Appl. No.: 239,959

[22] PCT Filed: Oct. 2, 1987

[86] PCT No.: PCT/AU87/00334

§ 371 Date: Aug. 5, 1988

§ 102(e) Date: Aug. 5, 1988

[87] PCT Pub. No.: WO88/02820

PCT Pub. Date: Apr. 21, 1988

[30] Foreign Application Priority Data

Oct. 7, 1986 [AU] Australia ..... PH8368

[51] Int. Cl.[4] ..... F01D 5/26; F01D 5/34

[52] U.S. Cl. ..... 415/98; 415/99; 416/171

[58] Field of Search ..... 415/98, 99, 170 A, 170 B, 415/173 A, 213 A; 416/185, 186 R

[56] References Cited

U.S. PATENT DOCUMENTS

| | | | |
|---|---|---|---|
| 3,319,573 | 5/1967 | Judd | 416/185 X |
| 3,384,026 | 5/1968 | Williamson, Jr. | 415/213 A |
| 3,731,940 | 5/1973 | Spruiell | 415/173 A |
| 4,277,222 | 7/1981 | Barbeau | 416/185 X |
| 4,664,592 | 5/1987 | Grzina | 415/170 B |

FOREIGN PATENT DOCUMENTS

| | | | |
|---|---|---|---|
| 466912 | 4/1948 | Canada | 415/170 B |
| 698291 | 11/1930 | France | 416/186 |
| 55-75591 | 6/1980 | Japan | 416/185 |

*Primary Examiner*—Robert E. Garrett
*Assistant Examiner*—Hoang M. Nguyen
*Attorney, Agent, or Firm*—Amster, Rothstein & Ebenstein

[57] ABSTRACT

A centrifical slurry pump impeller comprises auxilliary vanes located on at least one side surface thereof, an annular projection joining the auxilliary vanes at or adjacent the periphery of the impeller, and at least one further projection extending between adjacent auxilliary vanes and spaced substantially from both ends of the adjacent auxilliary vanes to form pockets intermediate the adjacent auxilliary vanes with the annular projection, thereby to limit recirculation of the working fluid of the pump along the face of the impeller containing the auxilliary vanes.

8 Claims, 3 Drawing Sheets

IMPELLERS FOR CENTRIFUGAL PUMPS

This invention relates to improvements in centrifugal pumps; more particularly to pumps used for pumping fluids with abrasive solids in suspension. A problem in pumping fluids of this nature is the abrasive action and wear on the components and resultant enlargement of clearances between the rotary and stationary members and consequent leakage and slippage of the fluid pumped, serious loss of head and efficiency and a reduction in serviceable life of the wearing parts, particularly the impeller and parts of the casing, or the casing liners, adjacent the sides of the impeller.

A means commonly employed to alleviate this problem is to provide the sides of the impeller with a plurality of auxilliary vanes projecting towards, and conforming with suitable running clearance to the walls of the casing adjacent the impeller. These auxillary vanes can be of various designs such a straight radial, straight inclined to radial, curved or a combination of such shapes; their objective being to minimise, by their centrifugal action on the fluid in the side clearance spaces, leakage and ingress thereto of fluid with abrasive suspended particles discharged from the impeller. Such vanes as are in use have been described for this purpose as outwardly diverging so that at the circumference of the impeller the periphery space between adjacent vanes is much greater—typically two or three times as great—as it is at the inner ends of the vanes. (see Australia Pat. No. 22513).

In more recent improvements (Australia Patent Application No. 30237/84) a ring has been extended around the periphery of the impeller to minimise the inward penetration of fluid discharged from the impeller and the associated ingress of abrasive particles into the side clearances between the impeller and casing.

A problem however with all these previous inventions is that the centrifugal pressure field generated by these auxilliary vanes causes a net flow of fluid from the inner (boss end) of the vane passage to the periphery. This flow sets up a recirculating pattern in the clearance between the rotating impeller and the stationary side of the casing as the fluid flows back along the wall of the casing to replace that which is pumped out between the auxiliary vanes (see FIG. 1). This recirculating flow of abrasive fluid causes severe wear problems which result in increased clearances which further exacerbates the resulting recirculation and wear.

It is the primary objective of the present invention to provide auxilliary impeller side vanes so designed as to restrict this recirculation and thus improve the wear life of the impeller and casing or casing liners.

In one broad form the invention comprises a centrifugal slurry pump impeller comprising: auxilliary vanes located on at least one side surface thereof; an annular projection joining the vanes, at or adjacent the periphery of the impeller; and at least one further projection extending between adjacent auxilliary vanes.

The peripheral annular projection extends all the way around the circumference however the internal projections may form an annular ring or rings or be discontinuous forming pockets between the auxilliary vanes.

The main aim of these annular projections is to disrupt the smooth flow of abrasive fluid from the impeller boss to the periphery and thus reduce the level of recirculation.

The invention will now be described by way of example with reference to the accompanying drawings in which.

The embodiments of the present invention shown in the beforementioned drawings comprises a plurality of auxilliary vanes outwardly projecting from the sides of the impeller 1 and conforming with suitable running clearances to the walls of the casing 2 within which the impeller rotates.

Figure 1:
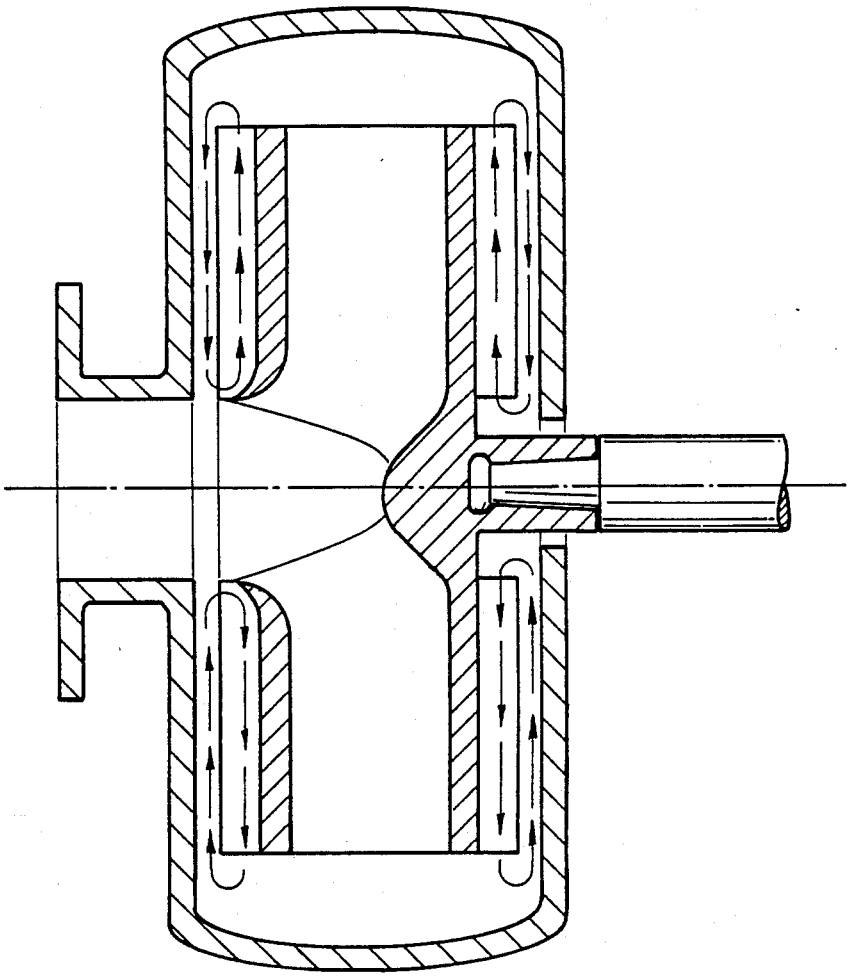
FIG. 1 illustrates a sectional view of a prior art impeller in the casing of a centrifugal pump.
Figure 3:
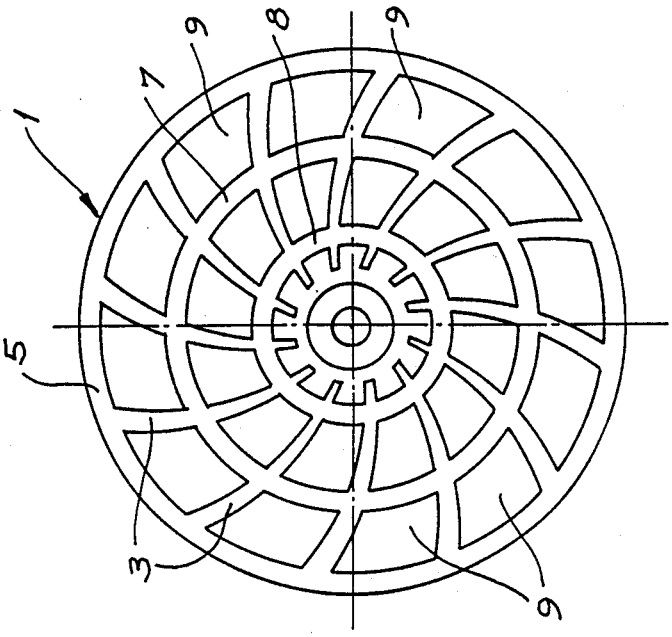
FIG. 3 illustrates a bottom plan view of the impeller illustrated above showing the position of the back auxilliary vanes and projections.
Figure 2:
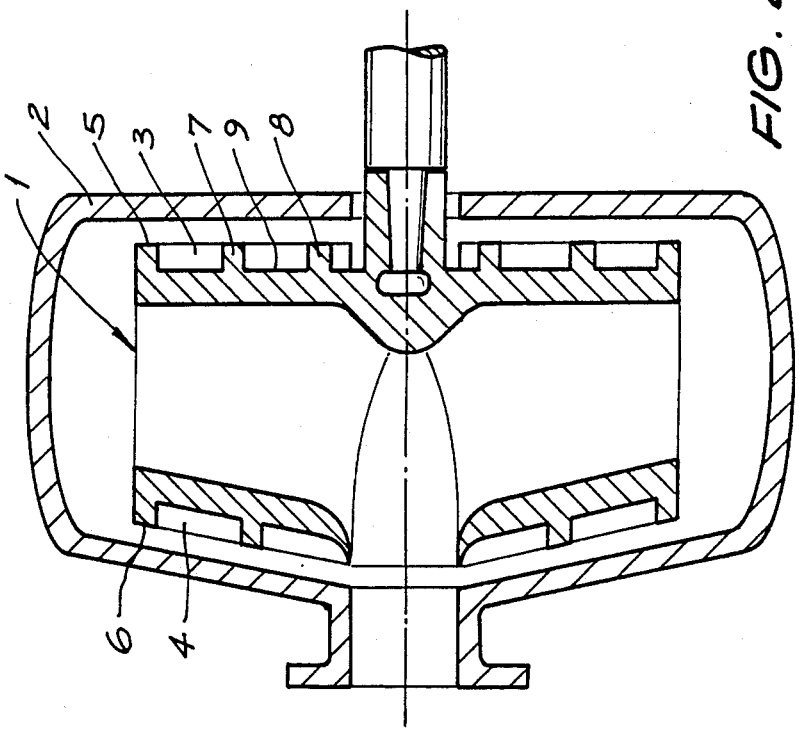
FIG. 2 illustrates a sectional view of the impeller according to one embodiment of the present invention in the casing of a centrifugal pump.

As shown in FIGS. 2 and 3 there is provided a plurality of radially extending auxillary vanes 3 and 4 (backwardly sloping with respect to the direction of rotation) located on the shaft side and inlet side respectively of the impeller 1. Located in this embodiment on the periphery of the impeller 1 are annular projections 5 and 6 which join the respective radial auxilliary vanes 3 and 4. Concentric projections 7 and 8 are provided on the back surface of the impeller to form pockets 9 thereon.

The heights of the various auxilliary vanes and projections are identical but could vary depending upon the individual pump geometry. Likewise the number of concentric annular projections could vary.

Figure 4:
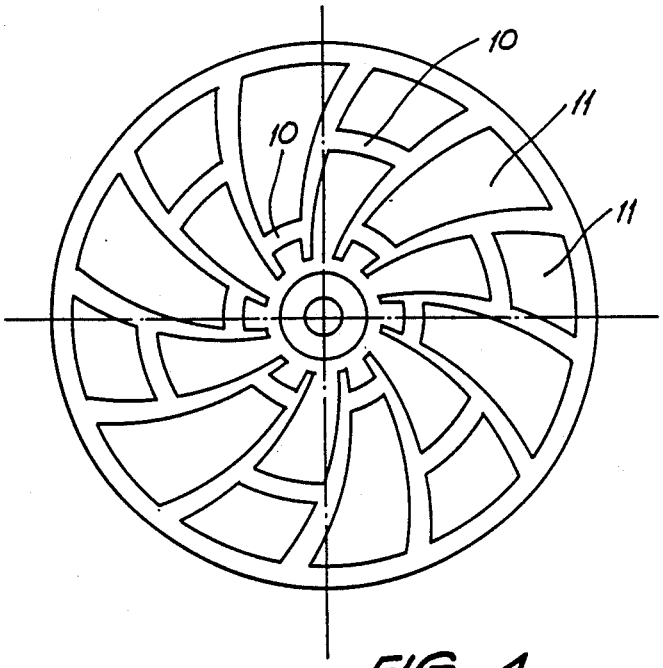
FIG. 4 illustrates a bottom plan view of a second embodiment of the invention showing the discontinuous annular projections and auxilliary vanes.

Another embodiment of the present invention is shown in FIG. 4 wherein the internal projections 10 are staggered with respect to adjacent internal projections, to produce irregular shaped pockets 11.

While the projections 10 are shown as arcuately extending they could be of any suitable shape or configuration such as straight, sloping or bent.

Further it should be obvious to people skilled in the art that modifications can be made to the impeller described above without departing from the spirit or the scope of the present invention.

I claim:

1. A centrifugal slurry pump impeller comprising:

auxilliary vanes located on at least one side surface thereof;

an annular projection joining the outer ends of the auxilliary vanes at or adjacent the periphery of the impeller; and at least one further projection extending between adjacent auxilliary vanes and spaced substantially from both ends of the adjacent auxilliary vanes to form pockets intermediate said adjacent auxilliary vanes with said annular projection.

2. A centrifugal slurry pump impeller according to claim 1 wherein said at least one further projection comprises an annular projection concentric to the first annular projection.

3. A centrifugal slurry pump impeller comprising:

auxilliary vanes located on at least one side surface thereof;

and annular projection joining said auxilliary vanes at or adjacent the periphery of the impeller; and at least one further projection extending between adjacent ones of said auxilliary vanes and comprising discontinuous projections forming pockets intermediate said adjacent auxilliary vanes.

4. A centrifugal slurry pump impeller comprising:

auxilliary vanes located on at least one side surface thereof;

a first annular projection joining the outer ends of said auxilliary vanes at or adjacent the periphery of the impeller; and at least one further annular projection extending between adjacent auxilliary vanes concentric to the first annular projection and spaced substantially outwardly from the inner ends of said adjacent auxilliary vanes to form pockets intermediate said adjacent auxilliary vanes with said first annular projection.

5. An impeller for a centrifugal pump comprising:

a planar rotatable member having an axis of rotation;

a plurality of substantially radially extending primary vanes located on one face of said rotatable member and forming a central intake opening aligned along the axis of rotation, said primary vanes being adapted to pump liquid through the pump when said impeller is positioned in a pump casing;

a plurality of generally radially directed auxilliary vanes located on the other face of said rotatable member and extending from near a central portion of said other face to adjacent the periphery of said rotatable member, said auxilliary vanes projecting axially from said other face;

an annular projection running about the periphery of the outer ends of said auxilliary vanes; and at least one further annular projection concentric to said peripheral annular projection and so located intermediate said peripheral annular projection and said axis of rotation to cooperate with said peripheral annular projection to limit recirculation of the working fluid of the pump along said other face.

6. An impeller for a centrifugal pump according to claim 5 wherein said at least one further projection comprises a discontinuous series of segments, each segment extending between adjacent ones of said auxilliary vanes.

7. An impeller for a centrifugal pump comprising:

two substantially parallel rotatable members aligned to rotate about a common axis of rotation and defining a central intake opening in one of said rotatable members aligned along the axis of rotation;

a plurality of substantially radially extending primary vanes extending between said rotatable members and generally radially from the axis of rotation, so as to pump liquid through the pump when said impeller is installed in a pump casing;

a plurality of generally radially directed auxilliary vanes located on an outer face of at least one of said rotatable members from near a central portion of said outer face to adjacent the periphery of said at least one rotatable member, said auxiliary vanes projecting axially from said outer face;

an annular projection running about the periphery of said at least one rotatable member along said outer face and connecting with the outer ends of said auxilliary vanes; and at least one further annular projection concentric to said peripheral annular projection and so located intermediate said peripheral annular projection and said axis of rotation to cooperate with said peripheral annular projection to limit recirculation of the working fluid of the pump along said outer face.

8. An impeller for a centrifugal pump according to claim 7 wherein said at least one further projection comprises a discontinuous series of segments, each segment extending between adjacent ones of said auxilliary vanes.

* * * * *